US006851228B1

(12) United States Patent
Forman

(10) Patent No.: US 6,851,228 B1
(45) Date of Patent: Feb. 8, 2005

(54) STORAGE STRUCTURE

(76) Inventor: Steve E. Forman, 6416 N. Detroit Ave., Portland, OR (US) 97217

( * ) Notice: Subject to any disclaimer, the term of this patent is extended or adjusted under 35 U.S.C. 154(b) by 0 days.

(21) Appl. No.: 10/306,476

(22) Filed: Nov. 27, 2002

(51) Int. Cl.[7] ..... E04B 1/32
(52) U.S. Cl. ..... 52/81.2; 52/80.1
(58) Field of Search ..... D25/1, 7; 4/494; 239/17, 23; 52/3, 11, 80.1, 81.2

(56) References Cited

U.S. PATENT DOCUMENTS 3,901,439 A * 8/1975 Willis ..... 239/12
4,068,421 A * 1/1978 Marovich ..... 52/81.4
4,197,684 A * 4/1980 Johnson ..... 52/102
4,531,635 A * 7/1985 Cleveland ..... 206/457
4,754,852 A * 7/1988 Mule et al. ..... 181/149
4,836,142 A * 6/1989 Duback ..... 119/255
5,033,243 A * 7/1991 Worms et al. ..... 52/245
5,395,577 A * 3/1995 Gorski ..... 264/227
5,415,221 A * 5/1995 Zakryk ..... 165/283
5,501,178 A * 3/1996 Kemp ..... 119/74
5,826,373 A * 10/1998 Mrdjenovich ..... 47/33
5,866,858 A * 2/1999 Dewey ..... 181/151
6,405,937 B1 * 6/2002 Stukenberg ..... 239/12

OTHER PUBLICATIONS http://www.caesars.com/Paris/LasVegas/Hotel/Amenities/.*

* cited by examiner

*Primary Examiner*—Leslie A. Braun
*Assistant Examiner*—Steven Marsh

(57) ABSTRACT

Structures are desirable for storing items in an attractive manner. Persons frequently have a need to store items outdoors, such as lawn care equipment. Structures are aesthetically pleasing by providing a rock-shaped storage enclosure. A pool with a circulation system may be present on the top of the cover of the structure. Additional accessories, such as fountains, birdbaths, weathervanes, bird feeders, birdhouses, and waterwheels may also be attached to the top of the cover as desired. A door hingedly attached to the side of the cover allows access to the interior of the structure.

5 Claims, 4 Drawing Sheets

STORAGE STRUCTURE

BACKGROUND OF THE INVENTION

1. Field of the Invention

The present invention relates to a storage structure for use in connection with yards. The structure has particular utility in connection with storing items in an attractive manner.

2. Description of the Prior Art

Structures are desirable for storing items in an attractive manner. Persons frequently have a need to store items outdoors, such as lawn care equipment. Traditional storage sheds are often not very aesthetically pleasing. Structures provide an attractive storage space by combining functionality with decorative elements. In particular, structures are shaped like a natural rock and have optional features like pools, weathervanes, birdhouses, and the like.

The use of methods of producing artificial rocks and waterfalls is known in the prior art. For example, U.S. Pat. No. 5,911,927 to Roberts discloses a method of producing artificial rocks and waterfalls. However, the Roberts '927 patent does not have a hingedly attached door, and has further drawbacks of lacking a recirculating pool.

U.S. Pat. No. 5,826,373 to Mrdjenovich discloses artificial landscaping boulders that simulate the appearance of natural boulders. However, the Mrdjenovich '373 patent does not have a hingedly attached door, and additionally does not have a recirculating pool.

Similarly, U.S. Pat. No. 4,754,852 to Mule et al. discloses a simulated rock speaker assembly that is a simulated rock speaker cabinet in the form of a natural rock. However, the Mule et al. '852 patent does not have a hingedly attached door, and does not have a recirculating pool.

In addition, U.S. Pat. No. 4,531,635 to Cleveland discloses a hiding place for keys and similar articles that resembles a natural object such as a rock. However, the Cleveland '635 patent does not have a hingedly attached door, and also does not have a recirculating pool.

Furthermore, U.S. Pat. No. 5,090,167 to Wassell discloses a solar shed that generates electricity by photovoltaic cells. However, the Wassell '167 patent does not have a hingedly attached door, and further lacks a recirculating pool.

Lastly, U.S. Pat. No. Des. 448,092 to Rinninger discloses a paving stone that is generally cube-shaped. However, the Rinninger '092 patent does not a hingedly attached door, and has the additional deficiency of lacking a recirculating pool.

While the above-described devices fulfill their respective, particular objectives and requirements, the aforementioned patents do not describe a structure that allows storing items in an attractive manner. The above patents make no provision for a hingedly attached door or a recirculating pool.

Therefore, a need exists for a new and improved structure that can be used for storing items in an attractive manner. In this regard, the present invention substantially fulfills this need.

In this respect, the structure according to the present invention substantially departs from the conventional concepts and designs of the prior art, and in doing so provides an apparatus primarily developed for the purpose of storing items in an attractive manner.

SUMMARY OF THE INVENTION

In view of the foregoing disadvantages inherent in the known types of methods of producing artificial rocks and waterfalls now present in the prior art, the present invention provides an improved structure, and overcomes the above-mentioned disadvantages and drawbacks of the prior art. As such, the general purpose of the present invention, which will be described subsequently in greater detail, is to provide a new and improved structure which has all the advantages of the prior art mentioned heretofore and many novel features that result in a structure which is not anticipated, rendered obvious, suggested, or even implied by the prior art, either alone or in any combination thereof.

To attain this, the present invention essentially comprises a hollow rock-shaped cover supported by an interior space frame.

There has thus been outlined, rather broadly, the more important features of the invention in order that the detailed description thereof that follows may be better understood and in order that the present contribution to the art may be better appreciated.

The invention may also include a doorway cut in the side of the cover, along with a hingedly attached door. A pool may be present on the top of the cover. The pool may drain into a drainpipe that feeds an inlet pipe. A pump may be connected to the inlet pipe. The pump may feed an outlet pipe. The outlet pipe may be connected to an outlet attached to the side of the pool. Accessories including birdbaths, birdhouses, bird feeders, weathervanes, fountains, and waterwheels may be attached to the top of the cover. The space frame may have a top support, a middle support, and a bottom support. The top support and the bottom support may be circular or elliptical in shape. The space frame and the cover may be made of wood, plastic, steel, aluminum, titanium, or carbon fiber composite. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved structure that has all of the advantages of the prior art methods of producing artificial rocks and waterfalls and none of the disadvantages.

It is another object of the present invention to provide a new and improved structure that may be easily and efficiently manufactured and marketed.

An even further object of the present invention is to provide a new and improved structure that has a low cost of manufacture with regard to both materials and labor, and which accordingly is then susceptible of low prices of sale to the consuming public, thereby making such structure economically available to the buying public.

Still another object of the present invention is to provide a new structure that provides in the apparatuses and methods of the prior art some of the advantages thereof, while simultaneously overcoming some of the disadvantages normally associated therewith.

Even still another object of the present invention is to provide a structure for storing items in an attractive manner. This allows the user to camouflage the presence of a storage shed.

Still yet another object of the present invention is to provide a structure for storing items in an attractive manner. This makes it possible to store items outdoors.

An additional object of the present invention is to provide a structure for storing items in an attractive manner. This enables the user to adorn the structure with desired accessories.

A further object of the present invention is to provide a structure for storing items in an attractive manner. This prevents the pool from becoming stagnant.

Lastly, it is an object of the present invention to provide a new and improved structure for storing items in an attractive manner.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
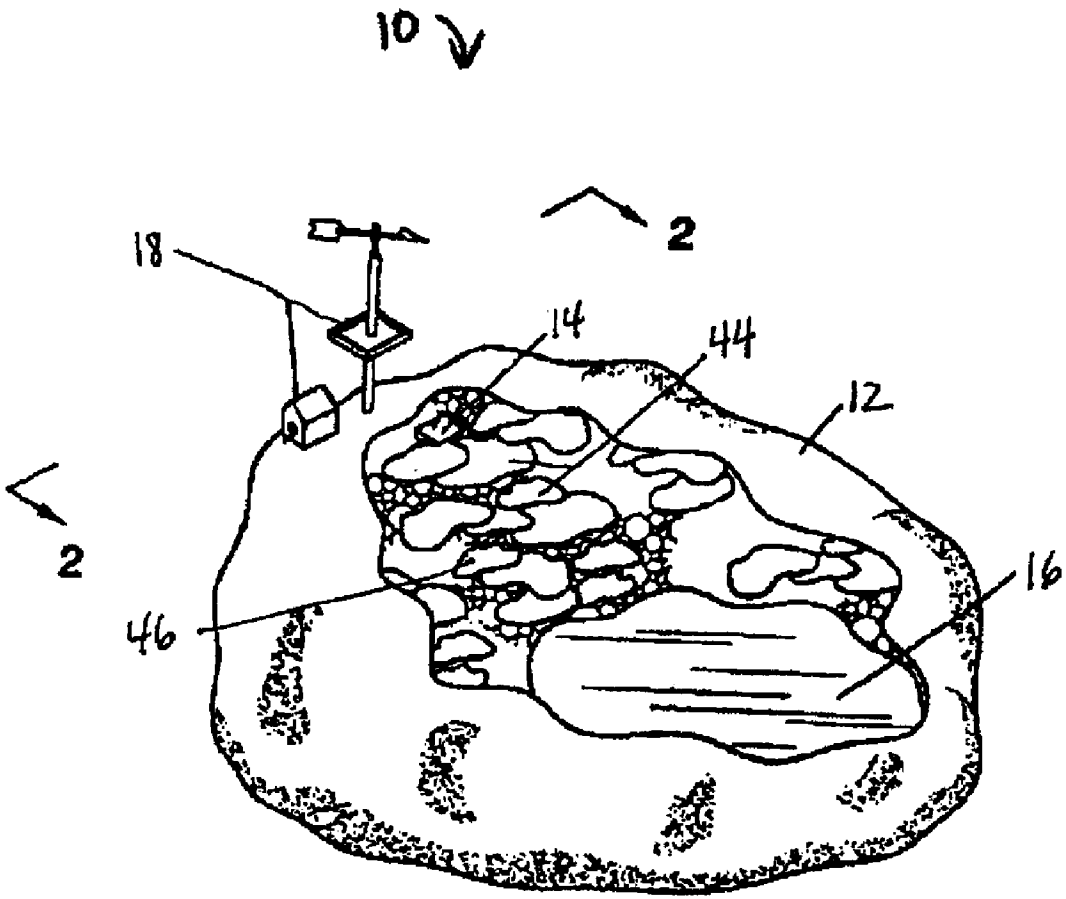
FIG. 1 is a top perspective view of the current embodiment of the structure constructed in accordance with the principles of the present invention.

Referring now to the drawings, and particularly to FIGS. 1–4, a current embodiment of the structure of the present invention is shown and generally designated by the reference numeral 10.

In FIG. 1, a new and improved structure 10 of the present invention for storing items in an attractive manner is illustrated and will be described. More particularly, the structure 10 has a cover 12. Cover 12 is hollow, rock-shaped, and made of plastic in the current embodiment. On the top of cover 12 is pool 16 with outlet 14 in its side. Outlet 14 feeds water into pool 16 flowing the water over the rocks 44 comprising the waterfall 46. The rocks 44 cause the water to flow turbulently, thereby aerating the water and promoting conditions that allow the water in pool 16 to be fresh, clear, and sweet smelling. Accessories 18 are also present on the top of cover 12. In the current embodiment, accessories 18 are a birdhouse and a weathervane.

Figure 2:
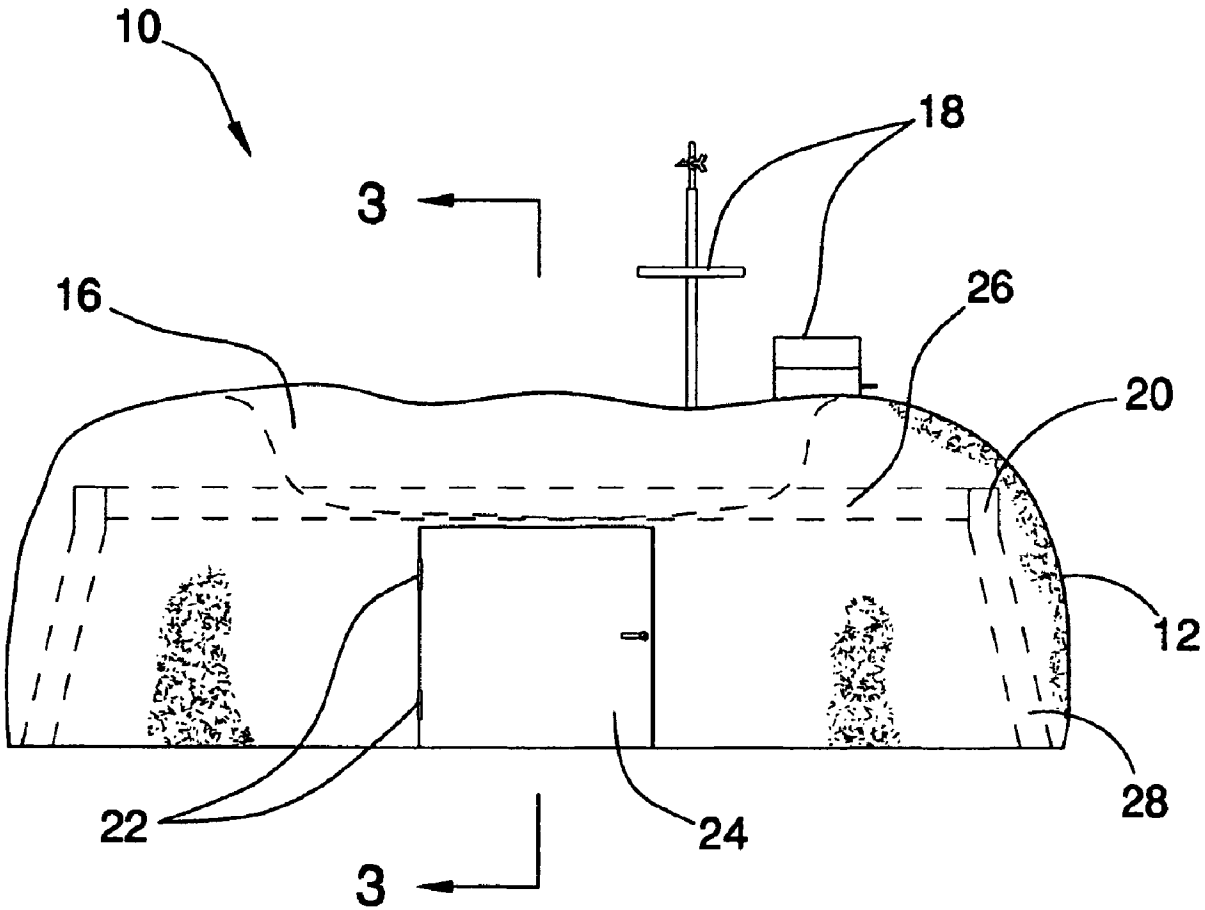
FIG. 2 is a side view of the structure of the present invention.

Moving on to FIG. 2, a new and improved structure 10 of the present invention for storing items in an attractive manner is illustrated and will be described. More particularly, the structure 10 has a cover 12 enclosing space frame 20. Broken lines illustrate space frame 20 which supports cover 12 and has a top support 26 and a middle support 28. Broken lines denote pool 16 in the top of cover 12. Hinges 22 attach door 24 to the side of cover 12. Door 24 provides access to doorway 32 (not shown), which leads to the interior of cover 12. Accessories 18 are shown attached to the top of cover 12. In the current embodiment, space frame 20 is made of aluminum.

Figure 3:
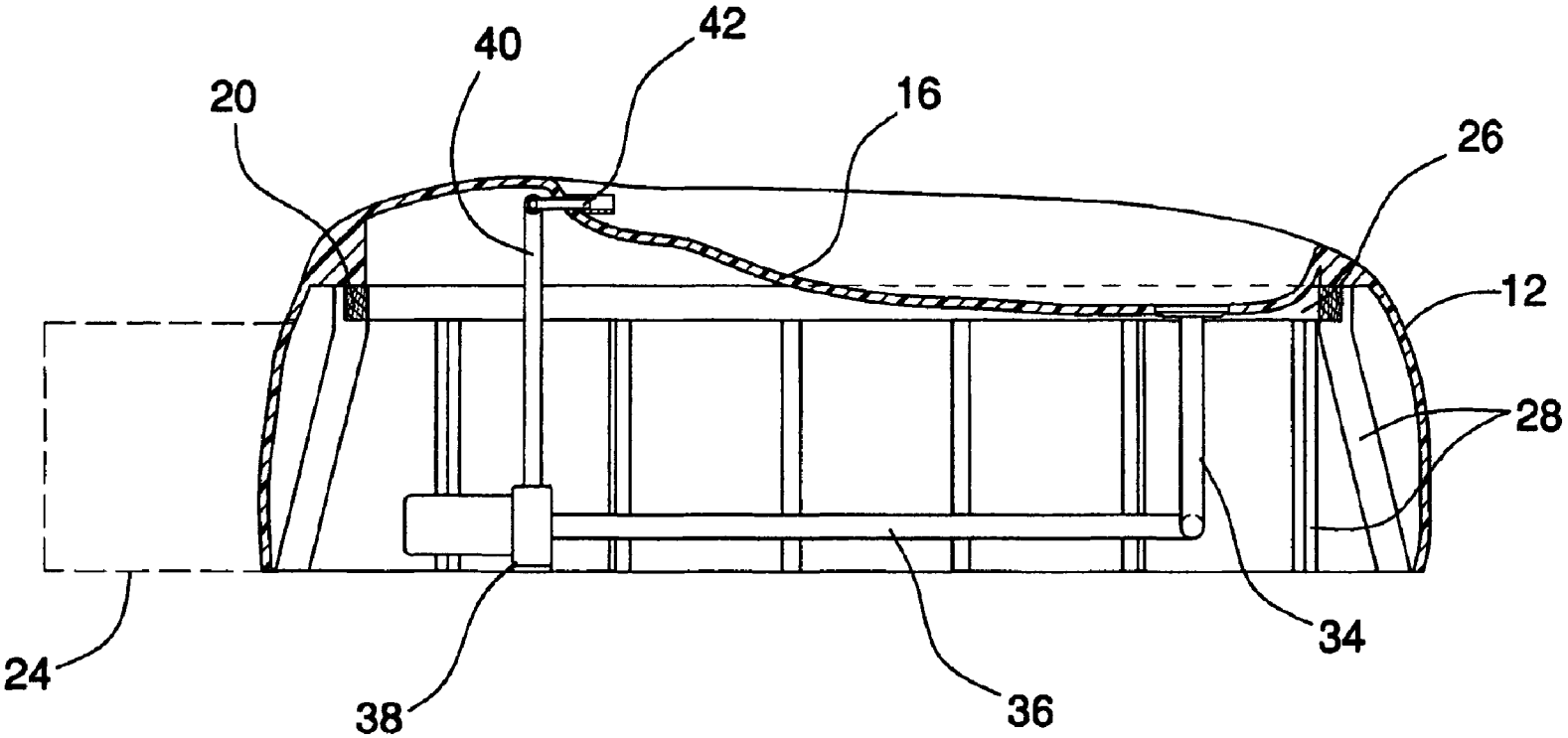
FIG. 3 is a side sectional view of the pool of the present invention.

Continuing with FIG. 3, a new and improved pool 16 of the present invention for storing items in an attractive manner is illustrated and will be described. More particularly, the pool 16 is located on the top of cover 12. Pool 16 drains into drain pipe 34. Pump 38 pumps water from drainpipe 34 via inlet pipe 36. Pump 38 discharges water into outlet pipe 40 and then through outlet 42 into pool 16. Pump 38 ensures that the water in pool 16 does not become stagnant and also creates a waterfall effect at outlet 42. The top support 26 and middle supports 28 of space frame 20 are visible. Broken lines illustrating door 24 in its open position are also present.

Figure 4:
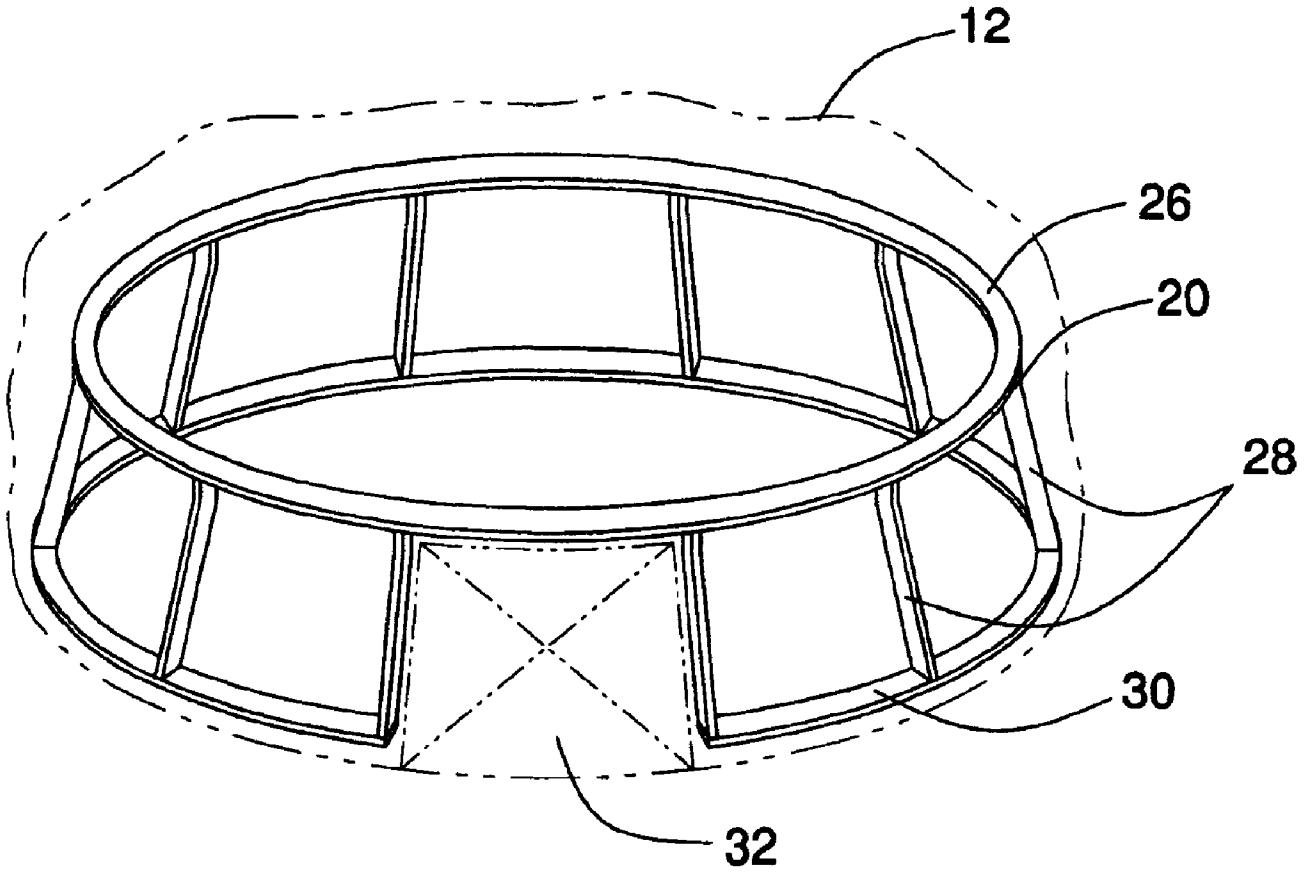
FIG. 4 is a top perspective view of the space frame of the present invention.

Concluding with FIG. 4, a new and improved structure 10 of the present invention for storing items in an attractive manner is illustrated and will be described. More particularly, the structure 10 has a cover 12 supported by space frame 20. The side of cover 12 has a hole to form doorway 32 denoted by the dotted lines forming an X. Doorway 32 allows access to the interior of cover 12. Space frame 20 has a top support connected to a bottom support 30 by middle supports 28. Bottom support 30 is in contact with the ground (not shown).

While a current embodiment of the structure has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as wood, steel, aluminum, titanium, or carbon fiber composite may be used instead of the plastic cover described. Also, the aluminum space frame may also be made of plastic, wood, steel, titanium, or carbon fiber composite. And although storing items in an attractive manner have been described, it should be appreciated that the structure herein described is also suitable for other purposes such as a playhouse for children or a shelter for pets. Furthermore, a wide variety of accessories may be used instead of the weathervane and birdhouse described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A structure comprising:

a hollow cover having a top and a side;

a pool having a bottom and a side wherein said top of said cover defines an indentation to comprise said pool;

a drainpipe having opposing ends with one end connected to said bottom of said pool;

an inlet pipe having opposing ends with one end connected to said opposing end of said drain pipe;

a pump connected to said opposing end of said inlet pipe;

an outlet pipe having opposing ends with one end connected to said pump;

an outlet having opposing ends with one end connected to said opposing end of said outlet pipe and said opposing end connected to said side of said pool;

a waterfall attached to said side of said pool, wherein said waterfall comprises a plurality of rocks that cause water flowing from said outlet to said p-oolto flow turbulently and become aerated;

a doorway having an edge wherein said side of said cover defines a hole therein to comprise said doorway;

a hinge attached to said edge of said doorway; and a door connected to said hinge.

2. The structure as defined in claim 1, further comprising a space frame enclosed by said cover.

3. The structure as defined in claim 1, wherein said cover resembles a rock in appearance.

4. The structure as defined in claim 1, further comprising an accessory attached to said top of said cover.

5. The structure as defined in claim 4, wherein said accessory is one or more of the group consisting of fountains, birdbaths, birdhouses, weathervanes, bird feeders, and waterwheels.

* * * * *